US005374116A

United States Patent [19]

Borgen et al.

[11] Patent Number: 5,374,116

[45] Date of Patent: Dec. 20, 1994

[54] ANTI-CONDENSATION PRODUCT VIEWING WINDOW FOR A VENDING MACHINE

[75] Inventors: Arden L. Borgen, Des Moines; Damon E. Rockwell, Grimes, both of Iowa

[73] Assignee: Fawn Engineering Co., Des Moines, Iowa

[21] Appl. No.: 54,390

[22] Filed: Apr. 28, 1993

[51] Int. Cl.[5] ..... A47F 3/00

[52] U.S. Cl. ..... 312/116; 312/138.1; 312/223.5; 62/250

[58] Field of Search ..... 312/114, 221, 222, 223.5, 312/116, 138.1; 62/248, 250

[56] References Cited

U.S. PATENT DOCUMENTS

| | | | |
|---|---|---|---|
| 2,014,830 | 9/1935 | Ahrens | 62/248 |
| 2,257,948 | 10/1941 | Green | 62/248 |
| 2,443,342 | 6/1948 | Colvin | 62/248 |
| 2,610,473 | 9/1952 | Chovanec | 62/250 |
| 2,671,001 | 3/1954 | Ossanna | 62/250 |
| 2,846,284 | 8/1958 | Fitzgerald | 312/223.5 |
| 3,346,310 | 10/1967 | Diack | 312/114 |
| 3,612,848 | 10/1971 | Koch | 312/223.5 X |
| 3,911,245 | 10/1975 | O'Shaughnessy | 62/248 X |
| 4,660,903 | 4/1987 | Shinagawa | 312/116 |
| 4,815,302 | 3/1989 | Aoki et al. | 62/250 X |
| 4,973,109 | 11/1990 | Diedrich | 312/114 |
| 4,977,754 | 12/1990 | Upton et al. | 312/116 X |

FOREIGN PATENT DOCUMENTS

| | | | |
|---|---|---|---|
| 1-306988 | 12/1989 | Japan | 312/223.5 |

*Primary Examiner*—Edward K. Look
*Assistant Examiner*—Hoang Nguyen
*Attorney, Agent, or Firm*—Henderson & Sturm

[57] ABSTRACT

A vending machine with an anti-condensation product viewing window. The product viewing window has two window sections. The first window section is typically a wall or portion of a wall of the product storage chamber. A second window section is spaced outwardly a distance from the first window section to form the face of the viewing window. An illumination device is placed between the first and second window section. The heat from the illumination device prevents a build up of condensation on the window sections. Substantially sealing the two window sections further reduces the condensation build up. One or more small openings in the sealings between the two window sections into a cooler area allow for the escape of any moisture which does accumulate between the two window sections. The illumination device can also be used to illuminate the products to be vended, back light a sign on the machine or both.

15 Claims, 1 Drawing Sheet

ANTI-CONDENSATION PRODUCT VIEWING WINDOW FOR A VENDING MACHINE

AUTHORIZATION PURSUANT TO 37 CFR 1.71 (d) (e)

A portion of the disclosure of this patent document may contain material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

1. Technical Field

The present invention relates generally to vending machines and more particularly to an improved apparatus for reducing and eliminating condensation on the window used to view products to be delivered in cold product vending machines.

2. Background Art

Vending machines are used to deliver a wide variety of products. Some vending machines allow you to select a product by written or graphical description, such as a typical soda vending machine, while others allow you to actually see the various products that may be selected, such as a typical candy/snack vending machine. In vending machines of the latter type there is a need for a relatively large viewing window such that the products can be viewed. This large window can present a problem when the vending machine stores products that must be kept cool, cold or frozen.

Condensation will form on the outside surface of the viewing window because the ambient temperature in the room where the vending machine is placed will often be warmer than the inside temperature of the storage compartment for the products to be vended. Using multiple panes of glass or plexiglass with a relatively small space between each pane helps to create a better insulated viewing window and thereby reduce the amount of condensation. However, this method alone does not eliminate the condensation problem.

The most common method of controlling the condensation build up on the viewing window is to warm the outermost pane. This is typically done by providing some sort of electrical heating film which is placed on the window. This method has two significant disadvantages. The first is that it requires additional electricity and thus makes the machine more costly to use. Second, the film characteristically is not completely transparent which reduces the visibility of the products to be vended. Assorted other heating methods placed on or within the outermost pane suffer from these same disadvantages.

Another problem with cold product vending machines which allow a user to view the various products is the illumination of the products. Typically, one or more lights are placed inside the housing chamber where the products are stored. However, these lights also introduce a significant amount of heat into the chamber which make the vending machine work harder to keep the temperature at the desire level. This causes additional wear on the machine as well as making it more costly to operate from an electrical efficiency perspective. Various lower heat light bulbs have been used to lessen this problem but have only slightly reduced the negative effects.

Thus, there is a need in a vending machine with an improved viewing window configuration which economically reduces and eliminates condensation and additionally allows for illumination of the products to be vended without causing significant warming of the housing chamber used to store the product.

DISCLOSURE OF THE INVENTION

The present invention relates generally to vending machines and more particularly to an improved apparatus for reducing and eliminating condensation on the window used to view products to be delivered in cold product vending machines. A vending machine built in accordance with the present invention begins with a first viewing window consisting of one or more panes typically arranged in parallel planes and spaced relatively close together. The illumination device which is usually inside the product chamber is placed outside the product chamber and relatively close to the first viewing window.

A second viewing window, usually consisting of only one pane of glass, is positioned in a parallel plane on the other side of the illumination device. The first and second windows are positioned to allow a user to see the products to be dispensed. The illumination device illuminates the products as before, just from outside the chamber.

The warmth given off by the illumination device is used to prevent condensation build up on the windows. The two windows can be substantially sealed with the illumination device within to help further reduce the build-up of condensation. Including one of more small passages in the seal which lead from the area between the windows to an area which is colder, typically inside the product storage chamber, allows for a means of escape for any moisture that does accumulate between the windows.

Finally, the illumination device can also be used to back light a sign place on or near the second window.

An object of the present invention is to provide an improved viewing window in a vending machine for reducing and eliminating condensation.

Another object of the present invention is to provide a vending machine viewing window which uses the light used to illuminate the products to be rended to warm the viewing window.

A further object of the present invention is to provide an improved viewing window which eliminates the need to place an illuminating device inside the product storage chamber.

Another object of the present invention is to provide a vending machine viewing window which reduces the consumption of electricity during operation.

Still another object of the present invention is to provide a vending machine viewing window which allows the same illumination device to illuminate the products to be rended as well as a back-lit advertising sign.

Other objects, advantages, and novel features of the present invention will become apparent from the following detailed description of the invention when considered in conjunction with the accompanying drawings.

BEST MODES FOR CARRYING OUT THE INVENTION

Figure 1:
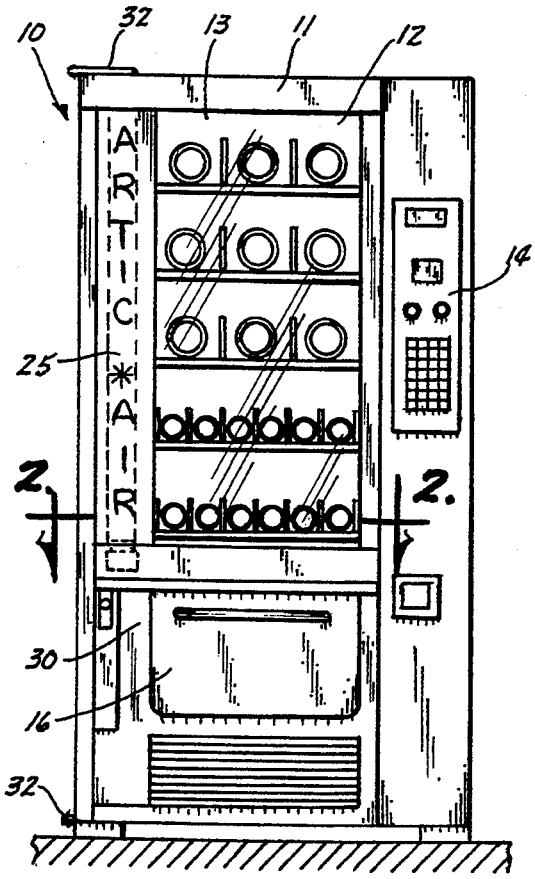
FIG. 1 is a front view of a vending machine with a viewing window built in accordance with the present invention.

Referring now to the drawings wherein like reference numerals designate identical or corresponding parts throughout the several views, FIG. 1 shows a vending machine (10) used for dispensing cold or frozen products having a housing (11) built in accordance with the present invention. The vending machine (10) has a product viewing window (12) which allows a user of the vending machine (10) to see inside the product housing chamber (13) used to store the products to be dispensed and select the products desired. The user makes his or her selection from a control panel (14) and the products drop into a holding bin. The user then opens a door (16) to the holding bin and removes the dispensed product.

Figure 3:
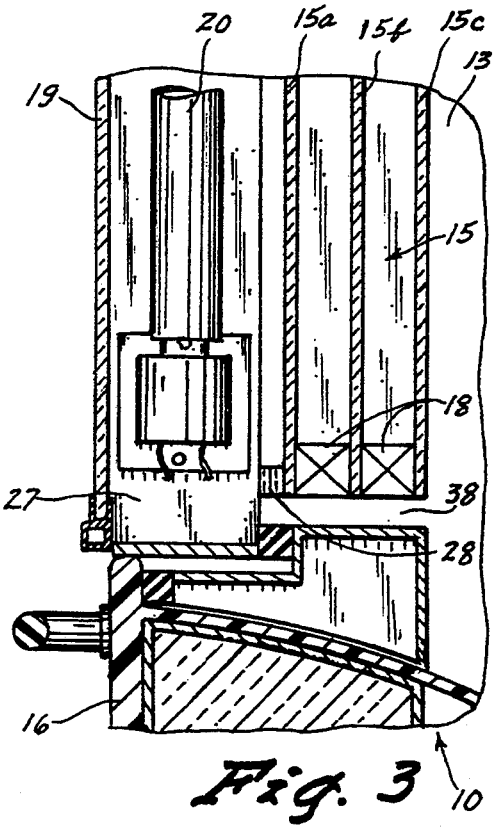
FIG. 3 is an enlarged detail sectional view taken along line 3—3 of FIG. 2 showing the light which is located within the viewing window.
Figure 2:
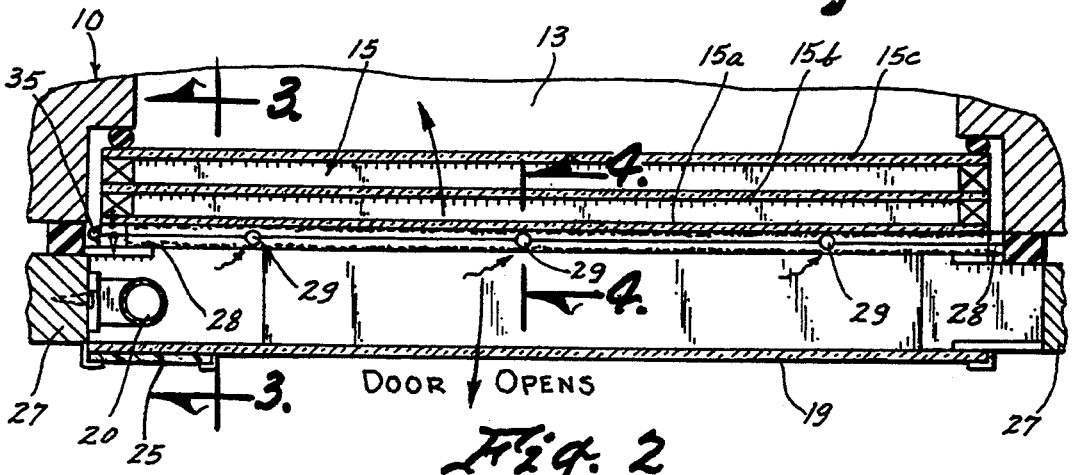
FIG. 2 is a horizontal sectional view taken along line 2—2 of FIG. 1 showing the viewing window.

Referring now to FIGS. 2 and 3, the product viewing window (12) consists of two separate window sections. The first window section (15) is a series of three panes of glass (15*a*, 15*b* and 15*c*) positioned in parallel planes. The multiple panes of the first window section (15) are separated from one another using a rubber sealer (18). Multiple sealed panes of glass are used to provide a thermal insulation. Obviously, the first window section (15) need not have exactly three panes. It could have one, two or more than three panes and still serve the same function with differing degrees of efficiency. A second window section (19) is made up of a single pane of glass. The second window section (19) is position in a parallel plane relative to the first window section (15). However, it is not necessary that the sections be parallel or of similar size. It is only necessary that the sections be positioned such that a user of the vending machine (10) can view the products to be dispensed.

An illumination device (20) is placed between the first window section (15) and the second window section (19). The illumination device (20) in this embodiment encompasses a fluorescent light and the ballast (not shown) used by the fluorescent light. The warmth emitted by the illuminating device (20) builds up between the first window section (15) and the second window section (19). The warmth prevents condensation from accumulating on the outer most pane (15*a*) of the first window section (15).

The illumination device (20) placed between the first window section (15) and the second window section (19) not only warms the air in the space created but it also illuminated the products inside the vending machine (10) making them easier to see for the user. This eliminates the need for an illumination device within the housing chamber (13) used to store the products. This is beneficial since it removes a heat source from within the housing chamber (13) thereby making it easier for the vending machine (10) to maintain a cooler temperature within the chamber (13) and reducing the amount of electricity used by the vending machine (10). Additionally, electricity is saved by the present invention by eliminating the need for a supplemental heating supply placed on or near the outermost pane to reduce condensation.

A sign (25) can be placed on or near the second window section (19). The illumination device (20) can be used to back light the sign (25). Additionally, the sign (25), if opaque, can be used to shield the user from the illumination device (25) and help reflect the light back into the housing chamber (13).

In order to further increase the effectiveness of the present invention, the space between the edges of the first window section (15) and the second window section (19) is substantially sealed. The second window section (19) is built into a frame (27). The outermost pane (15*a*) of the first window section (15) is separated from the frame (27) by a sealing strip (28). The sealing strip (28) is made of rubber, silicone or some other material with similar sealing characteristics. The sealing strip (28) can either be a single strip which is secured to one surface which meets with the other surface, or, as in this embodiment, can be two strips which are applied to each surface such that the strips meet each other.

Figure 4:
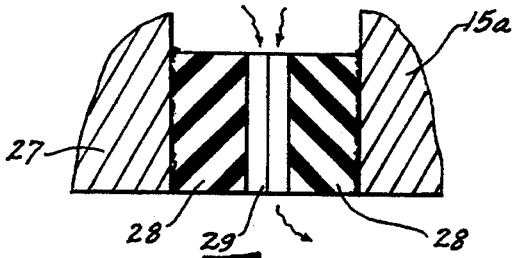
FIG. 4 is an enlarged detail vertical sectional view taken along line 4—4 of FIG. 2 showing a moisture escape channel in the seal of the viewing window.

Referring to FIGS. 2 and 4, one or more openings (29) are left in the sealing strip to provide a passageway for moisture which may be in the sealed area between the first window section (15) and the second window section (19). The openings (29) in the present embodiment are located in the seal on the bottom edge of the window sections. However, the openings (29) need not be located there since the moisture will naturally migrate from a warmer environment to a cooler one. To guarantee that the environment on the other side of the opening (29) is cooler, the openings (29) of the present invention are connected to a passage way (38) which leads into the housing chamber for storing the products to be dispensed.

Referring to FIGS. 1 and 2, the frame (27) for holding the second window section (19) makes up a portion of a door (30) for the vending machine (10) The door (30) pivots with respect to the vending machine (10) on hinges (32) allowing access to the product storage chamber. The first window section (15) pivots with respect to the door (30) and second window section (19) on hinges (35). The first window section (15) can only pivot when the door (30) is open.

We claim:

1. A vending machine for dispensing products, comprising:
   - housing chamber means for storing said products to be dispensed;
   - a first transparent wall portion;
   - means for cooling said housing chamber means;
   - a second transparent wall portion spaced from said first transparent wall portion wherein a spaced is formed between said first transparent wall portion and said second transparent wall portion; and
   - means for warming the space between said first transparent wall portion and said second transparent wall portion wherein said warming means includes an illumination device.

2. The vending machine of claim 1 wherein said illumination device comprises a fluorescent light.

3. The vending machine of claim 1 wherein said illumination device comprises a fluorescent light and a ballast.

4. The vending machine of claim 1 wherein said illumination device includes means for illuminating the products to be dispensed are illuminated.

5. The vending machine of claim 1 including a sign visible to a user of said vending machine and wherein said illumination device includes means for illuminating said sign.

6. The vending machine of claim 3 including means for substantially sealing the space between said first and said second transparent wall portions.

7. The vending machine of claim 6 including at least one opening disposed in said sealing means and including a passage way connecting said at least one opening and said housing chamber means whereby moisture accumulation in the space between said first and said second transparent wall portions may pass through said passage way into said housing chamber means.

8. The vending machine of claim 1 wherein said warming means is disposed between said first and said second transparent wall portions.

9. The vending machine of claim 1 wherein said illumination device is disposed between said first and said second transparent wall portions.

10. The vending machine of claim 1 further including a door movable between portions opening and closing said housing chamber means, said door including said first and said second transparent wall portions.

11. The vending machine of claim 10 including means for pivoting said door with respect to said housing chamber means.

12. The vending machine of claim 11 including means for pivoting said first transparent wall portion with respect to said second transparent wall portion.

13. A vending machine for dispensing products, comprising:

housing means forming a chamber for storing products to be dispensed, said housing means having a first transparent wall portion;

means for cooling said housing chamber means;

said housing chamber means having a second transparent wall portion spaced from said first transparent wall portion wherein a space is formed between said first and said second transparent wall portions; and means for warming the space between said first and said second transparent wall portions wherein said warming means includes an illumination device.

14. The vending machine of claim 13 wherein said warming means is disposed between said first and said second transparent wall portions.

15. The vending machine of claim 3 wherein said first transparent wall portion comprises more than one pane of glass.

* * * * *